United States Patent [19]

Johnson

[11] 4,039,243

[45] Aug. 2, 1977

[54] ELECTRICAL CONNECTOR

[75] Inventor: Paul D. Johnson, Cupertino, Calif.

[73] Assignee: James B. Lansing Sound, Inc., Los Angeles, Calif.

[21] Appl. No.: 720,568

[22] Filed: Sept. 7, 1976

[51] Int. Cl.[2] ..... H01R 9/10

[52] U.S. Cl. ..... 339/274; 24/134 R

[58] Field of Search ..... 339/270, 274, 201, 202; 24/132 AB, 132 AC, 134 R

[56] References Cited

U.S. PATENT DOCUMENTS

| | | | |
|---|---|---|---|
| 361,705 | 4/1887 | Litchfield | 339/274 |
| 3,976,353 | 8/1976 | Harbauer | 339/274 |

*Primary Examiner*—Joseph H. McGlynn

*Attorney, Agent, or Firm*—Poms, Smith, Lande & Glenny

[57] ABSTRACT

An electrical connector comprising a binding post intended to be fixed to a suitable supporting surface such as the wall of a loudspeaker enclosure, and including an outwardly extending portion provided with a camming surface disposed spirally relative to the axis of the binding post, and an operating cap of dielectric material, desirably having at least slight elastic deformability, and provided with a conductor-receiving bore extending therethrough and disposed eccentrically relative to the axis of the binding post and cap. The lower body portion of the cap has formed therein a downwardly open cavity for partially receiving the operative portions of the binding post, whereby twisting the cap through a limited angle, substantially less than 180°, serves to force the bared conductor within the cap into tight conductive relation with the cammed surface of the binding post. The cap is maintained in coaxial relation with the binding post by structure both above and below the cam, including an upper stud of the binding post journaled in a central bore in the upper part of the cap, and by compressional engagement between the lower peripheral skirt of the cap and a slightly elliptical flange on the binding post, immediately beneath the cam.

13 Claims, 9 Drawing Figures

Fig. 5.
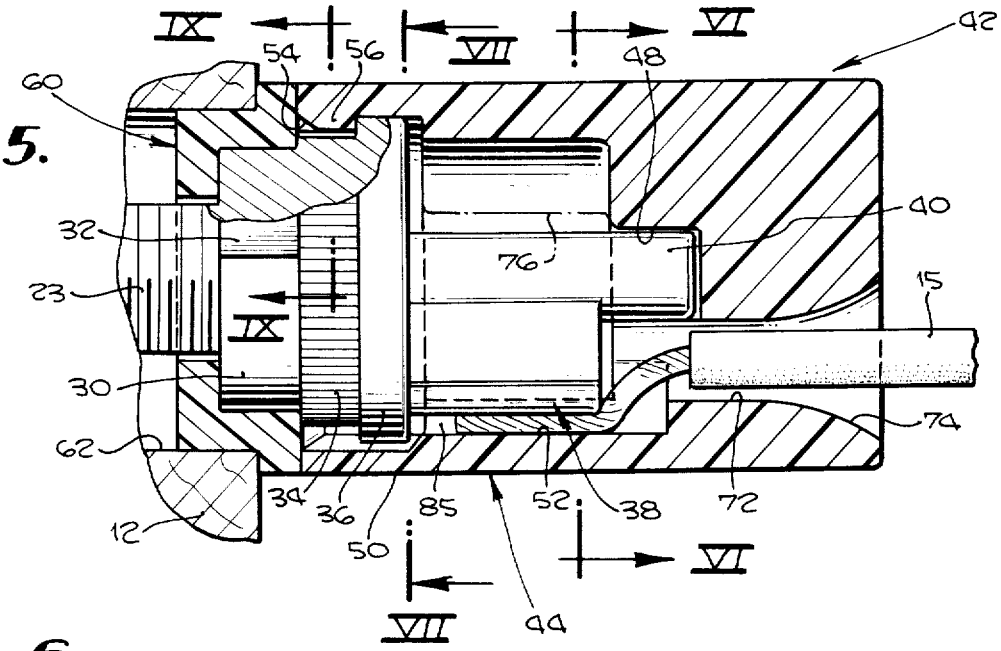
Fig. 6.
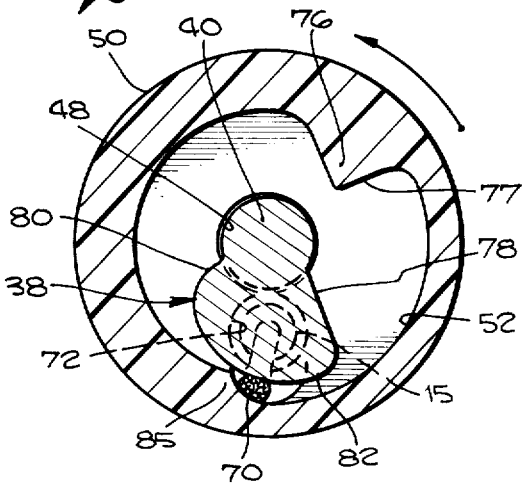
Fig. 8.
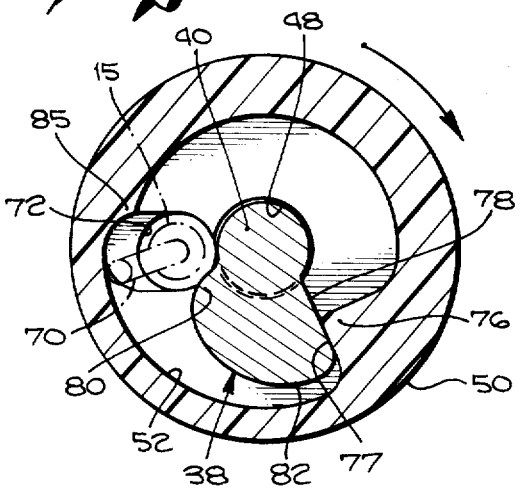
Fig. 9.
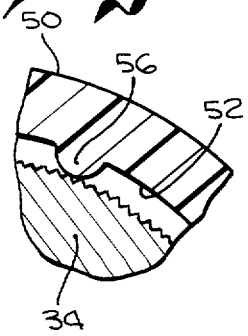
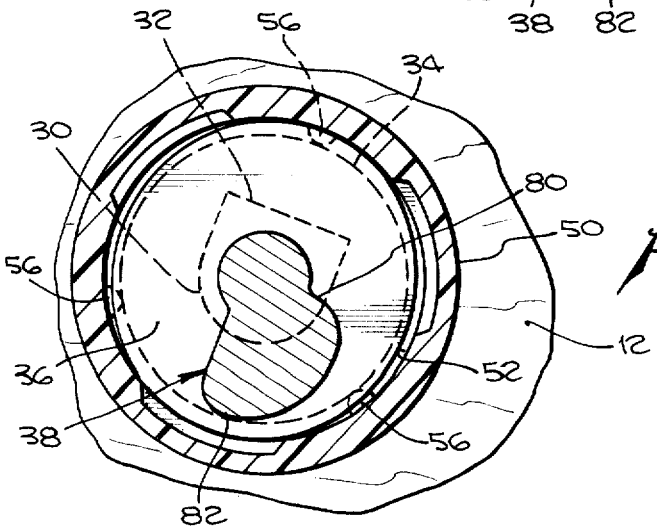
Fig. 7.

ELECTRICAL CONNECTOR

BACKGROUND AND SUMMARY OF THE INVENTION

This invention relates generally to electrical connectors, and more particularly to such a device for connecting a conductor, preferably in the form of a stranded wire, to a binding post forming part of the invention, the binding post being typically mounted on a supporting wall or other surface, here illustratively described as one of the enclosing walls of a loudspeaker.

Conventional electrical connectors including binding posts of various types have been proposed and used in the past, frequently requiring the use of hand tools such as pliers or a screwdriver in order to form the connection, and normally requiring that the user employ both hands in making the connection. In accordance with the present invention there is provided a connector having an internal binding post, specially configured as described below, together with an insulating cap mounted upon the binding post and rotatable through a limited angle relative thereto. The cap is provided with a bore extending therethrough, disposed eccentrically relative to the axis of the binding post and cap, into which an electrical lead can be inserted, with a bared portion of conductor at the end of the lead. The present connector finds particular application in making connection with a stranded conductor, as is used in carrying electricity as in a sound system, and will be described herein in connection with its use in connecting a wire to a loudspeaker. However, the invention is also applicable for connecting a solid conductor.

In accordance with a preferred form of the invention hereinafter described and shown in detail, a binding post is fixed to a supporting surface, and has a shank portion, which may be threaded, terminating in a terminal suitable for having an internal wire permanently soldered or affixed thereto. The upper or outer portion of the binding post includes a cam mounted upon a flange, the flange being desirably slightly elliptical about the central axis of the binding post. The insulator cap mentioned above, having an eccentric bore for receiving the conductor to be connected in accordance with the invention, also has a central bore which serves as a socket for rotatably receiving therein the uppermost stud portion of the binding post, in order to properly position the cap relative to the binding post. The lower portion of the cap includes a body having an internal downwardly open cavity formed therein defined by a generally cylindrical skirt, and the lower edge of the skirt includes fastening means, desirable in the form of inwardly extending protrusions, which snap over the flange of the binding post in order to maintain the cap attached to, but rotatable relative to the binding post. The material of the cap is of a suitable plastic dielectric material having some degree of elastic deformability, and the inside diameter of the lower portion of the skirt is such that it deforms slightly in receiving therein the flange, the relationship between the inner face of the skirt and the flange being compressional, so that the present connector resists inadvertent unfastening as a result, for example, of vibration or the like. At the same time, the connector can be easily disconnected by the user, by twisting the cap relative to the binding post.

The cap is easily rotatable by the user through a suitable angle, preferably between 90° and 180°, and stop means are provided on the cap for inner engagement with elements of the binding post, in order to limit angular movement of the cap relative to the binding post.

The object of the present invention is accordingly to disclose and provide a novel electrical connector. Other objects and purposes of the invention are to provide an electrical connector having a cap of dielectric material provided with a conductor-receiving bore therethrough, the cap being mounted upon a fixed binding post for limited angular rotation relative to the binding post; to provide in such a device a binding post having a cam formed thereon, and configurations on the inner surface of the dielectric cap for forcing the bared end of a conductor into electrical contact with the outer cammed surface of the binding post, during rotation of the cap relative to the binding post; to provide in such a device means for ensuring frictional resistance to inadvertent rotation of the cap relative to the binding post; to provide such a device easily useable by the user with only one hand, and in an environment where the user may not be able to see the connector and conductor; to provide such a device of unusual economy of manufacture and reliability in use; and for other and additional purposes as will be understood from a study of the following description of a preferred embodiment of the invention, taken in connection with the accompanying drawings.

BRIEF DESCRIPTION OF THE DRAWINGS

FIG. 5 is a fragmentary sectional view, on an enlarged scale, taken on arrows V—V of FIG. 2.

FIG. 6 is a transverse sectional view taken on arrows VI—VI of FIG. 5.

FIG. 7 is a transverse sectional view taken on the arrows VII—VII of FIG. 5.

FIG. 8 is a view similar to FIG. 6, showing the parts in their relative positions when disconnected from a conductor wire, the disconnected wire being shown in dotted outline.

FIG. 9 is a fragmentary sectional view, on an enlarged scale, taken on arrows IX—IX of FIG. 5.

DETAILED DESCRIPTION

Figure 1:
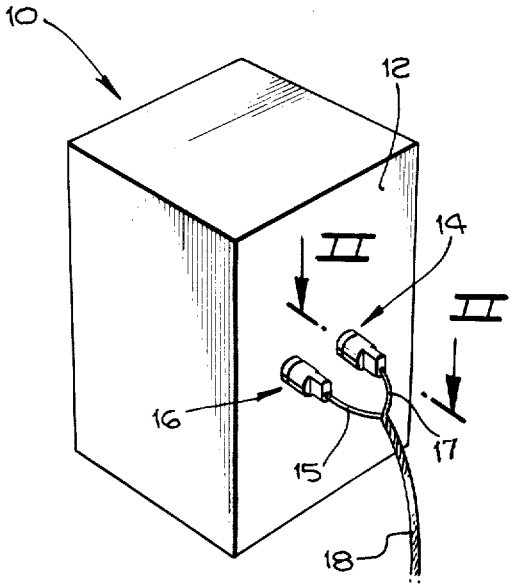
FIG. 1 is a perspective view of a loudspeaker or similar electrical device, with two connectors in accordance with the present invention mounted on the rear wall thereof.

In FIG. 1 there is indicated generally at 10 an electrically powered device such as a loudspeaker and having a rear wall 12 on which are mounted a pair of connectors in accordance with the present invention, indicated generally at 14 and 16 shown connected to respective leads 15 and 17, forming a cable 18.

The details of the present connector will be described first with reference to FIGS. 2 and 3, and the component parts and elements of the connector may be referred to herein with reference to their upper or lower orientation as seen in the exploded view of FIG. 3. Thus, as there shown, connector 14 includes a lower conductive binding post indicated generally at 20 and an upper cap of dielectric material indicated generally at 22. The binding post includes a downwardly extending shank 23 which may desirably be threaded as shown, and a lowermost terminal portion 24 desirably provided with an opening 25 therethrough, to which an internal lead 26 (see FIG. 2) may be soldered or otherwise attached in known manner.

Immediately above shank 23, binding post 20 includes a head 30, desirably having at least one flat side wall 32, and above head 30 is a cylindrical section 34, whose outer side wall may desirably be serrated, knurled or otherwise roughened as shown. Above section 34 is a flange indicated generally at 36, which may be cylindrical in section or, preferably, slightly elliptical. On the upper face of flange 36, and formed integrally therewith is a cam indicated generally at 38, and described in greater detail hereinafter. Projecting upwardly from cam 38 is a cylindrical stud 40, concentric with the cylindrical section 34 and with flange 36.

Figure 3:
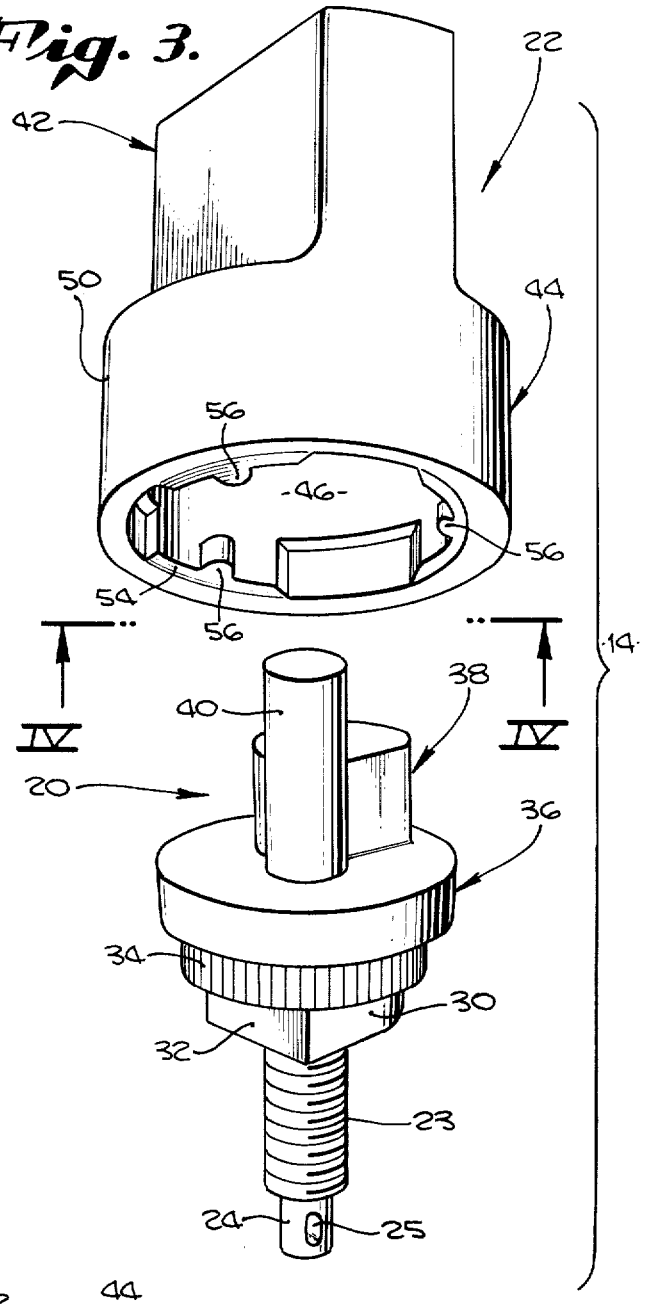
FIG. 3 is an exploded view of the component parts of the connector.
Figure 4:
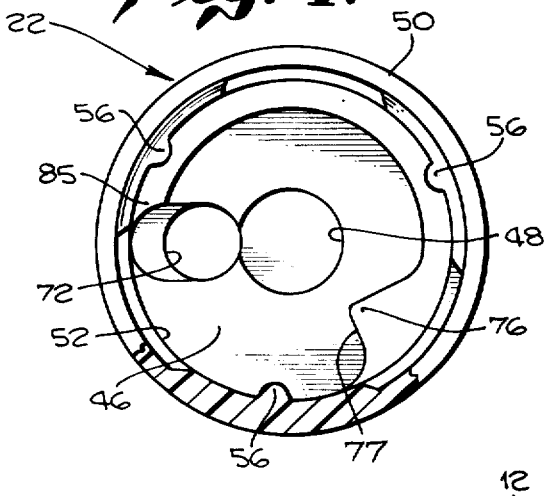
FIG. 4 is a view of the lower part of the cap, looking upwardly on arrows IV—IV of FIG. 3.

With continued reference to FIG. 3, cap 22 includes an upper handle portion indicated generally at 42 and a lower body portion indicated generally at 44 having formed therein a downwardly open cavity 46.

Figure 2:
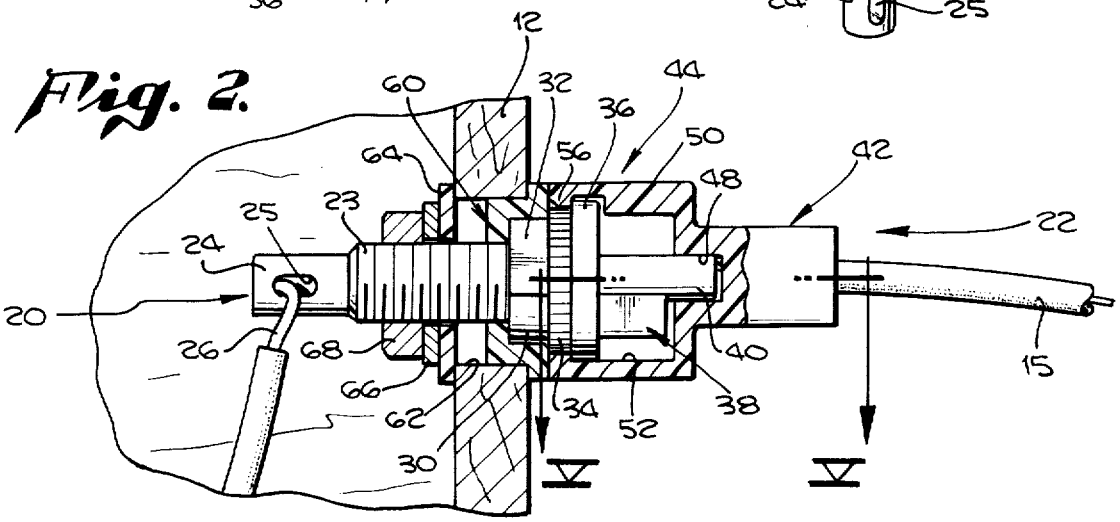
FIG. 2 is a sectional view looking downwardly on the arrows II—II of FIG. 1.

As seen in FIGS. 2 and 5, the lower portion of cap handle 42 is provided with an internal bore 48, having a diameter to rotatably receive therein stud 40 of the binding post. The lower body 44 of the cap includes a generally cylindrical skirt 50 which defines, in its upper portion, a generally cylindrical bore 52, having at its bottom a set of angularly spaced inwardly projecting protrusions 56, three being shown herein. In order to facilitate assembly of the cap 22 on binding post 20, the lowermost inner edges of the protrusions are desirably chamfered at 54.

Cap 22 is desirably formed of a material, such as a suitable plastic composition having at least some elastic deformability so that, when the cap and binding post are assembled as seen in FIGS. 2 and 5, the protrusions 56 snap into position beneath flange 36, the lower portion of skirt 50 having been slightly deformed during assembly to permit the protrusions to move downwardly past the flange. In the assembled relation, as best seen in FIGS. 7 and 9, the protrusions 56 may be in contact with the outer surface, preferably serrated, of the cylindrical section 34, in order to provide frictional resistance to rotation of cap 22 relative to the binding post.

Frictional resistance may preferably be provided by rubbing contact between inner wall 52 of skirt 50 and the outer surface of flange 36, particularly when the flange is provided with an outer side wall constituting an ellipse, and the inside diameter of the skirt portion mating with the flange desirably has a circumference equal to or slightly greater than the perimeter of the ellipse.

With further reference to FIG. 2, there may be provided an annular washer or spacer indicated generally at 60, received in an opening 62 formed in the wall 12. When used, spacer 60, desirably of dielectric material, is provided with an upwardly open central cavity for receiving head 30, the cavity being desirably so formed as to prevent relative rotation of the head within the cavity. As also appears in FIG. 2, the binding post is retained in assembled relation with wall 12 by a washer 64 of dielectric material, the parts being assembled with a lock washer 66 and a conventional nut 68 threaded on shank 23.

Operation of the present invention will be described in connection with FIGS. 5, 6 and 8, which show the wire conductor 70 of lead 15 in locked or connected position. Thus, lead 15 is received in a bore 72 extending through the handle portion 42 of cap 22 and disposed eccentrically relative to the axis of the cap. The upper end portion of bore 72, indicated at 74, is desirably flared divergently upwardly to facilitate the initial insertion of lead 15 and its stranded conductor 70 when the parts are in their open or inoperative positions seen in FIG. 8, the stranded conductor 70 being shown in dotted outline in that figure. It will be noted that the relative positions of the parts in FIG. 8 represent the extreme position of cap 22 when it is twisted clockwise as seen in FIG. 8, as indicated by the arrow therein, about the axis of the binding post, with bore 48 rotating relative to stud 40. Means are provided in accordance with the invention for limiting such clockwise movement, here shown as including an inwardly extending stop member 76 formed integrally with skirt 44 of the cap. More specifically, a wall 77 of protrusion 76 extends approximately parallel to a radial line of the cap and, with the parts in their position of FIG. 8, wall 77 abuts flat wall 78 of cam 38. The latter element includes a camming surface formed by a line substantially parallel to the axis of the binding post and extending from a point 80 of minimum radius from that axis to a point 82 at a maximum radius from the axis, the intervening surface being generally spiral relative to the axis.

With the parts in their open position of FIG. 8, the user rotates cap 22 counterclockwise from the FIG. 8 position to the FIG. 6 position, and it will be seen that such rotation carries with it the conductor 70, by the containment of lead 15 in bore 72. This tightening rotation continues until the conductor is tightly wedged against the outer helical surface of cam 38, making good electrical connection therewith. The size of conductor thereby determines the position at which tightening occurs assuring good electrical connection for any lead dimension which bore 74 will accept. If no conductor is present within the connector when the cap is rotated counterclockwise into its FIG. 6 position, the cap may move somewhat further in a counterclockwise direction as seen in FIG. 6, until shoulder 85 abuts the cam 38, prior to reaching the point 82 of maximum radius of the cam. This abutting engagement constitutes a second stop means, to prevent the cap from being rotated counterclockwise as seen in FIG. 6 beyond the desired point; the resulting rotation is in the present form of the invention desirably somewhat greater than 90°, but substantially less than 180°.

In the foregoing description of the operation, it will be understood that "clockwise" and "counterclockwise" are used with reference to the fact that the parts seen in FIGS. 6 and 8 are shown looking on the arrows VI—VI of FIG. 5, and the rotational terms are therefore opposite to those appearing to the user who grasps the handle portion 42 of cap 22 with his fingers to operate the connector. Otherwise stated, from the user's point of view, it is clockwise rotation of cap 22 which forms the connection in the present device by the wedging contact of stranded conductor 70 between the inner face of skirt 50 and the outer surface of cam 38.

The insulating washer or spacer 60 is desirable when the present connector is to be mounted upon a support member which is itself conductive, and from which it is necessary to insulate the electrical circuit formed by the connector. Thus it will be noted in FIG. 2 that, keeping in mind that washer 64 is made of dielectric insulating material, there is no electrical connection between the metallic conductive binding post 20 and the wall 12 in which the device is mounted. In cases where the supporting wall or similar structure is itself made of nonconductive material, the insulator washer 60 may be omitted and in such an arrangement, the head 30 of the binding post is received in a suitably formed opening in the wall member or other supporting structure, such opening being desirably provided with a flat surface abutable against a flat surface, such as face 32 of head 30, to prevent the possibility that the binding post might twist about its own axis during use. As will be readily understood, it is contemplated by the present invention that the binding post itself remains stationary, despite the torque indirectly applied to it by the user in forming a connection as described above, or subsequently in breaking that connection by removal of the conductor, as by rotation of the cap in the opposite direction from the direction of rotation used in making the original connection. The outer surface of cam 38, although referred to herein as "spiral", obviously need not be a precisely geometric spiral. Similarly, the preferred shape of flange 36, described herein as "eliptical," does not necessarily contemplate a true geometric ellipse, but more broadly an ovoid contour having maximum and minimum diameters, so that the inside diameter of the cap skirt, above protrusions 56, may have frictional contact with the flange at and near its points of maximum diameter.

It will thus be seen that there is here provided a simple and reliable connector for forming an electrical connection, easily operable by the user using only one hand, and particularly convenient where the connection must be made in cramped quarters.

Modifications and changes from the illustrative form of the invention hereinabove shown and described not departing from the spirit of the invention are intended to be embraced within the scope of the appended claims.

I claim:

1. An electrical connector comprising:

an elongated conductive binding post having a central vertical axis and a cam including a surface disposed spirally relative to the axis, and a cap rotatably mounted on the upper portion of the post and having formed therein a conductor-receiving bore eccentric to said axis, the cap including means for forcing a conductor into contact with the cam when the cap is rotated relative to the post.

2. The invention as defined in claim 1 including stop means carried by the cap for limiting angular rotation of the cap relative to the post.

3. The invention as defined in claim 1 wherein the forcing action provides for a wiping self-cleaning of cam and conductor.

4. The invention as defined in claim 1 wherein the forcing action provides for acceptance of a wide range of conductor sizes.

5. The invention as defined in claim 1 including interengaging means carried by the binding post and the cap for maintaining the post and cap in coaxial relation.

6. The invention as defined in claim 5 wherein said interengaging means include a central bore formed in the upper portion of the cap and a central upper stud carried by the binding post and rotatably journaled in the central bore.

7. The invention as defined in claim 6 wherein said interengaging means also include a flange formed on the post and a peripheral skirt formed in the lower portion of the cap for rotatably engaging the flange.

8. The invention as defined in claim 7 wherein the flange is slightly elliptical in shape.

9. The invention as defined in claim 8 wherein the cap is made of a material having at least slight elastic deformability, and the flange-contacting portion of the skirt is cylindrical with an inside diameter intermediate the major and minor diameters of the elliptical flange.

10. The invention as defined in claim 7 wherein the post includes a cylindrical section below the flange, having a circumferential wall recessed radially inwardly of the periphery of the flange.

11. The invention as defined in claim 10 wherein the lowermost portion of the skirt is provided with a plurality of angularly spaced inwardly projecting protrusions to retain the cap upon the cam and may contact said circumferential wall.

12. The invention as defined in claim 1 wherein the forcing action over the full height of the cam provides for a large surface area in contact with the conductor resulting in low contact resistance.

13. The invention as defined in claim 12 wherein certain multiple stranded conductors will be forced to contact a longer length of the cam giving a lower contact resistance.

* * * * *